US006402243B1

(12) United States Patent
Liu

(10) Patent No.: US 6,402,243 B1
(45) Date of Patent: Jun. 11, 2002

(54) SAFETY HARNESS STRUCTURE FOR ROCKING CHAIRS

(76) Inventor: Lausan Chung-Hsin Liu, No. 243, Chien-Kuo Rd., Hsin-Tien City, Taipei Hsien (TW)

( * ) Notice: Subject to any disclaimer, the term of this patent is extended or adjusted under 35 U.S.C. 154(b) by 0 days.

(21) Appl. No.: 09/908,581

(22) Filed: Jul. 20, 2001

(51) Int. Cl.[7] ..... A47C 3/02
(52) U.S. Cl. ..... 297/281; 297/270.1; 297/273
(58) Field of Search ..... 297/270.1, 270.2, 297/273, 281

(56) References Cited

U.S. PATENT DOCUMENTS 3,047,334 A * 7/1962 Vanderminden ..... 297/281
4,536,029 A * 8/1985 Rogers, Jr. ..... 297/281
4,700,920 A * 10/1987 Horn ..... 297/281
5,280,996 A * 1/1994 Trent ..... 297/270.2
6,224,658 B1 * 6/2001 Parent et al. ..... 297/270.2

* cited by examiner

*Primary Examiner*—Peter R. Brown
(74) *Attorney, Agent, or Firm*—Bacon & Thomas, PLLC

(57) ABSTRACT

A safety harness structure for a rocking chair. The structure includes a support frame and a chair mounting on the support frame through a pair of swinging bars. The swinging bars are pivotally engaged with two sides of the support frame and the chair through pivotal shafts located at the junctures of the support frame and the chair. The chair may swing to and fro relative to the frame about the pivotal shafts which function as fulcrums. The swinging bars are pivotally bridged by a restrictive rod for limiting the swinging angle of the swinging bars thereby to maintain the chair swinging within a selected displacement.

2 Claims, 3 Drawing Sheets

SAFETY HARNESS STRUCTURE FOR ROCKING CHAIRS

BACKGROUND OF THE INVENTION

1. Field of the Invention

The present invention relates to a safety harness structure for rocking chairs and particularly a harness structure that has a restrictive rod bridging a pair of swinging bars between the chair and a support frame to limit the swinging angle of the swinging bars for maintaining a desired swinging displacement for the chair.

2. Description of Related Art

In order to increase the versatility of chairs to offer people more comfortable sitting, many contemporary chairs have included swiveling or rocking or swinging designs. Conventional rocking chairs now available on the market generally consist of a chair mounting on a support frame located thereunder. The chair and support frame are linked by a pair of swinging bars at two sides. The junctures of the support frame and the swinging bars become fulcrums to allow the chair swinging through the swinging bars to and fro relative to the support frame.

However the construction set forth above has the risk of causing people sitting thereon to fall out of the chair. As there is not harness structure to limit the swinging angle, when the chair is swung forwards or rearwards at too large an angle, the gravitational acceleration resulting from the weight of the person sitting on the chair and the weight of the moving chair could exceed the critical angle of the support frame. As a result, the chair could loose balance and topple as shown in FIGS. 1 and 2. This could cause serious injury to the person sitting on the chair. When such events occur, besides safety concerns, the swinging bars will also be deformed or ruptured or result in damage to the rocking chair.

SUMMARY OF THE INVENTION

The primary object of the invention is to resolve the foregoing disadvantages. The invention aims to provide a harness structure that has a restrictive rod bridging a pair of swinging bars between the chair and support frame to limit the swinging angle of the swinging bars for maintaining a desired swinging displacement for the chair.

The foregoing, as well as additional objects, features and advantages of the invention will be more readily apparent from the following detailed description, which proceeds with reference to the accompanying drawings.

DESCRIPTION OF THE PREFERRED EMBODIMENT

Figure 1:
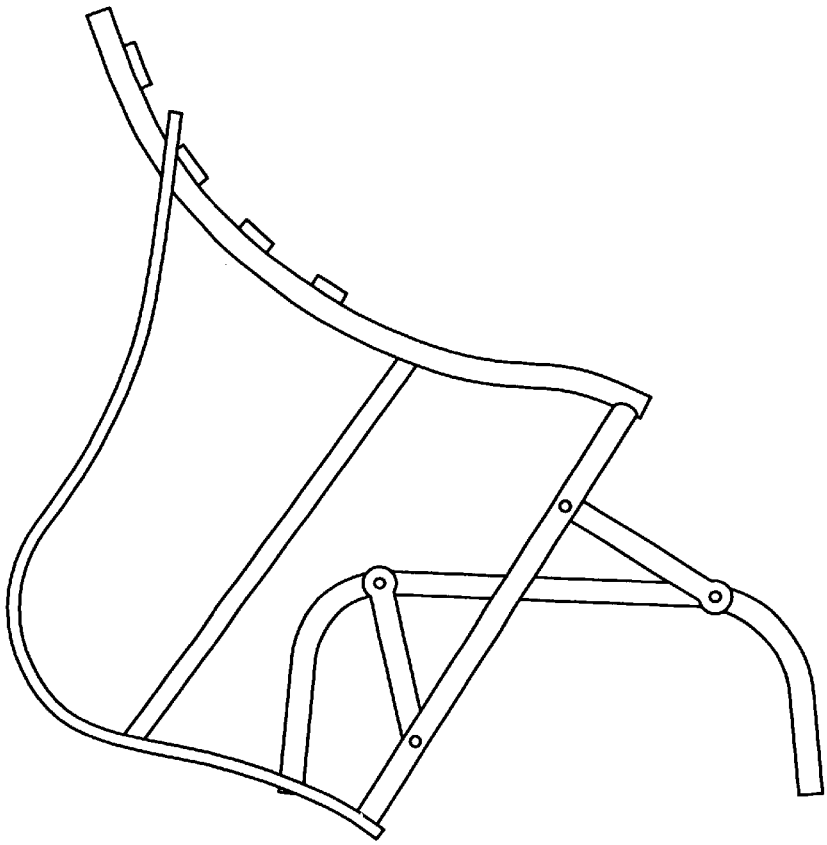
Fig.1 PRIOR ART
FIGS. 1 and 2 are schematic views of a conventional rocking under swinging.
Figure 2:
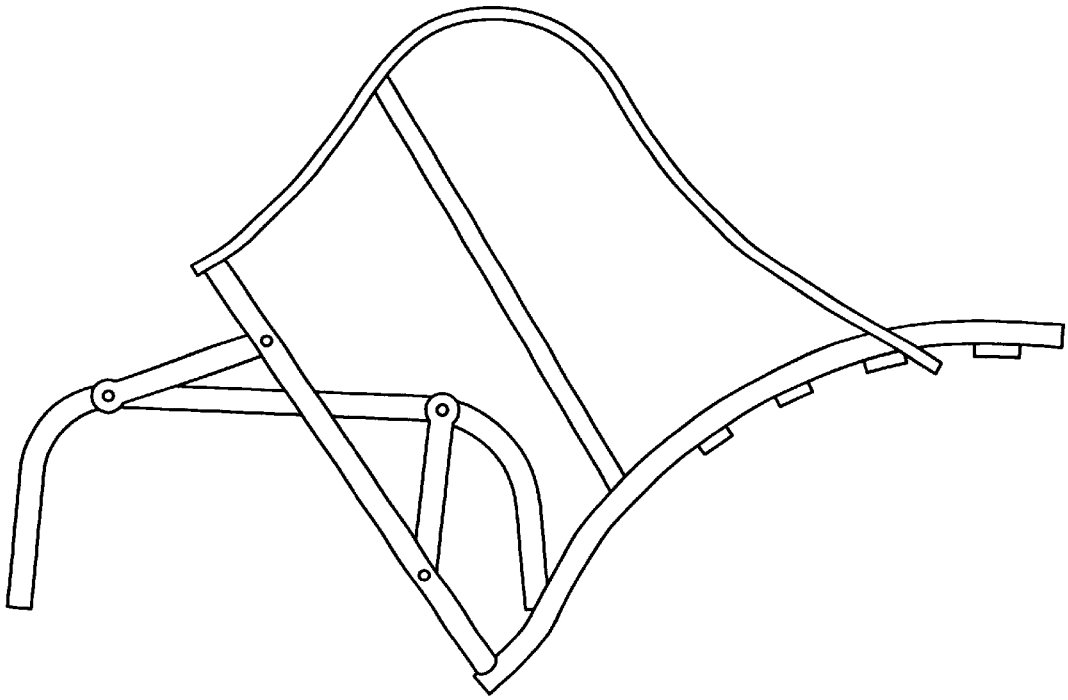
Fig.2 PRIOR ART
Figure 3:
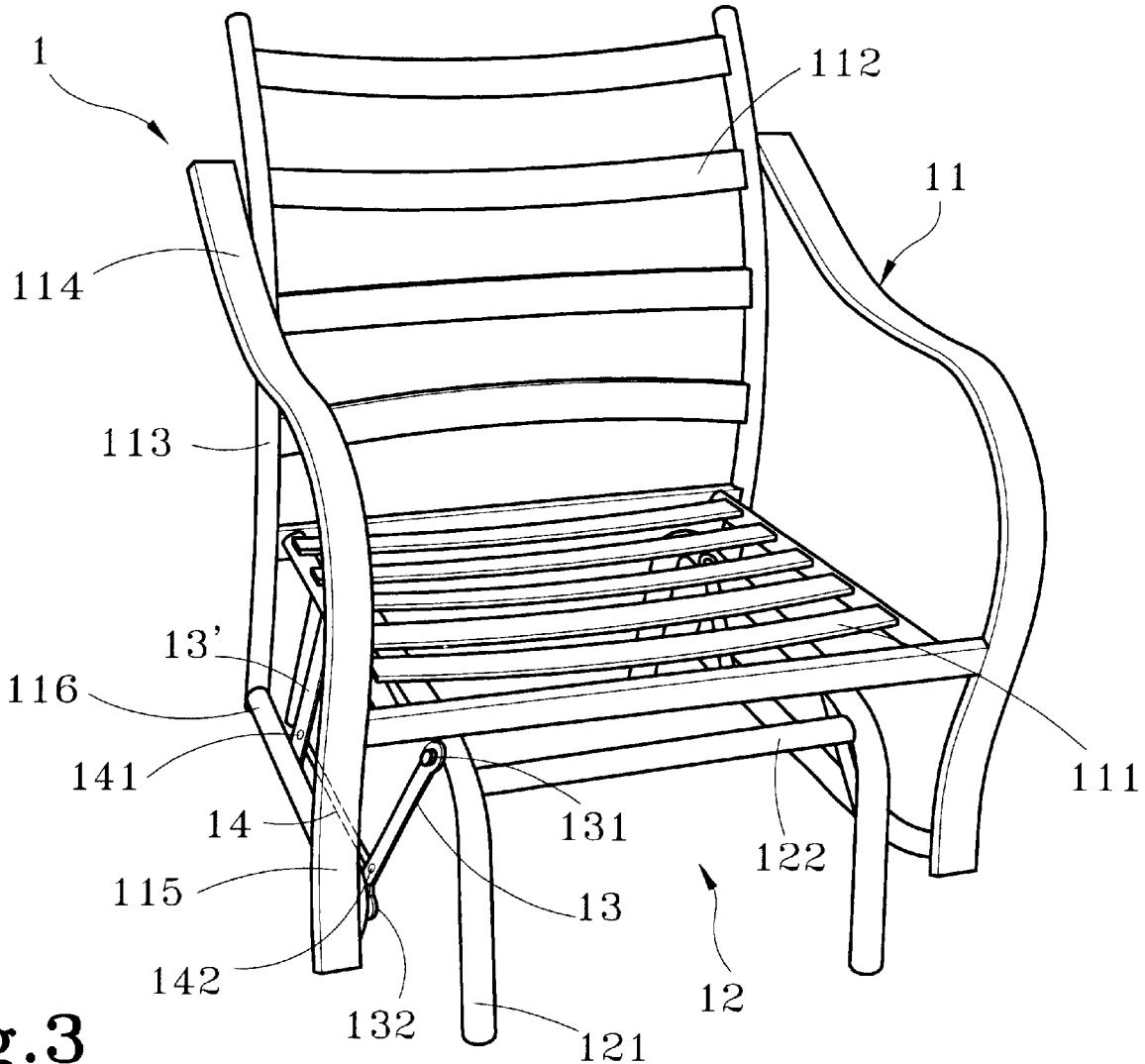
FIG. 3 is a perspective view of the invention.
Figure 4B:
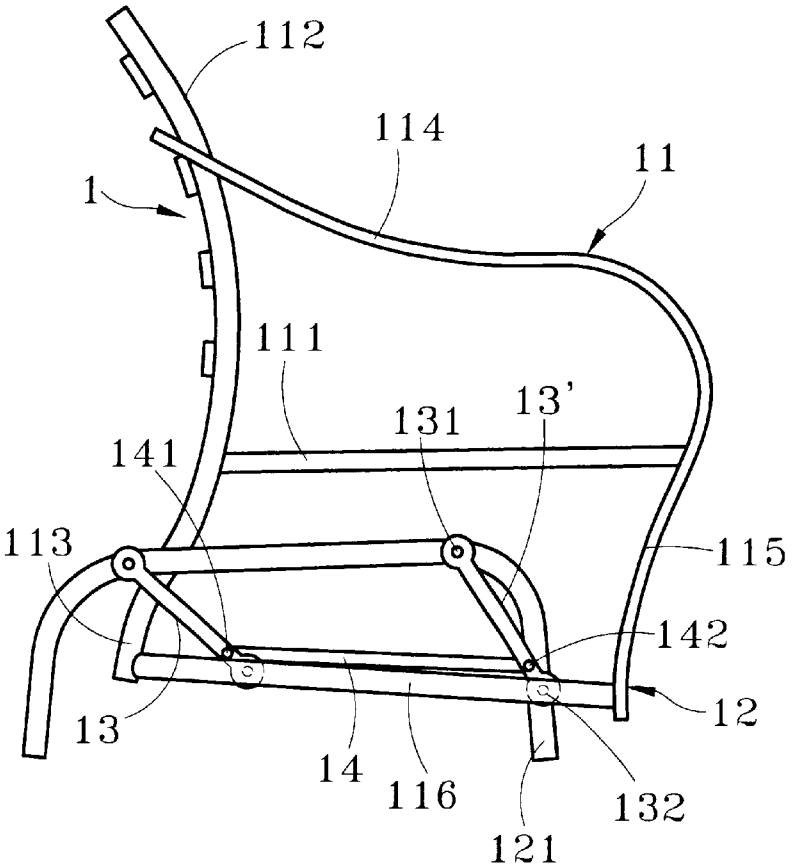
FIGS. 4A and 4B are schematic views of the invention under movement.
Figure 4A:
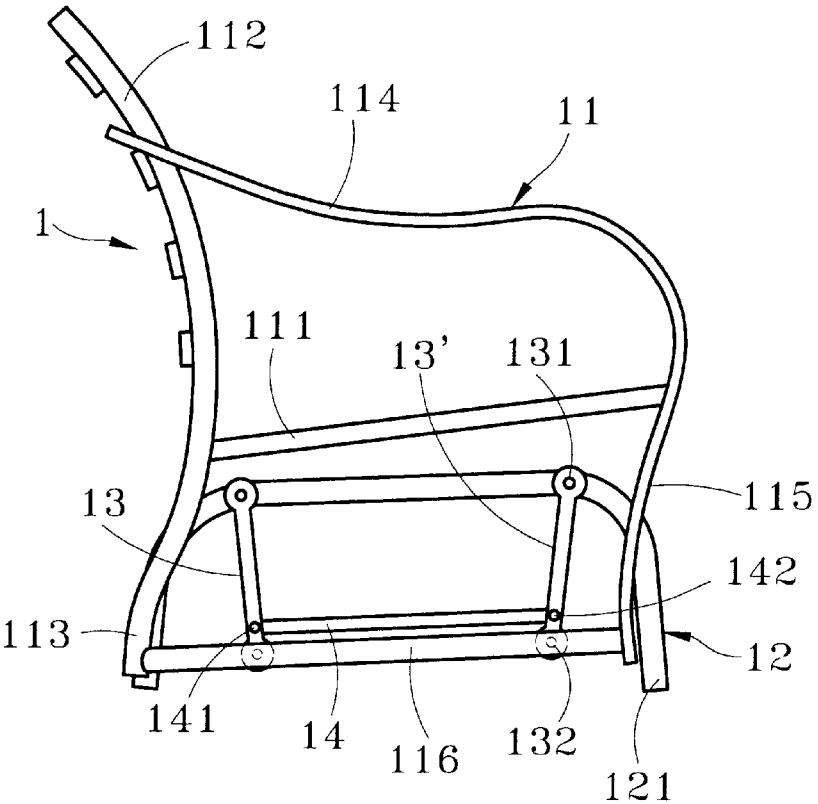

Referring to FIGS. 3, 4A and 4B, the rocking chair 1 of the invention consists of a support frame 12 and a chair 11 mounting on the support frame 12. The chair 11 includes a seat pad 111, a backrest 112 engaging with the rear end of the seat pad 111 and extending downwards to form rear legs 113, and a pair of armrests 114 fastening to two sides of the seat pad 111 and backrest 112 and extending downwards to form the front legs 115. The front leg 115 and rear leg 113 at either side are linked by a side stretcher 116. The support frame 12 includes two rods 121 having two ends bent to contact the ground surface and a plurality of transverse rungs 122. The support frame 12 and the side stretcher 116 are linked by a pair of swinging bars 13 and 13' pivotally engaged with the support frame 12 and the side stretcher 116 through pivotal shafts 131 and 132 at the junctures of the support frame 12 and the side stretcher 116. The pivotal shafts 131 and 132 function as fulcrums to allow the chair 11 swinging to and fro over the support frame 12. The two swinging bar 13 and 13' are pivotally bridged by a restrictive rod 14 through two fastening pins 141 and 142 located at two ends of the restrictive rod 14 to limit the swinging angle of the swinging bars 13 and 13'. The restrictive rod 14 is located closely to the junctures of the swinging bars 13 and 13' and the chair 11 such that the interval between the swinging bars 13, 13' and the chair 11 is no larger than the interval between the swinging bars 13, 13' and the support frame 12. Hence the swinging displacement of the chair 11 will be limited in a selected range.

Referring to FIGS. 4A and 4B, when in use, the chair 11 may swing relative to the support frame 12. The restrictive rod 14 will limit the swinging angle of the swinging bars 13 and 13' thereby will also limit the swinging displacement of the chair 11. Hence the chair 11 will be prevented from excessive swinging without toppling even subject to a great force. As a result, the invention can enhance the safety of the rocking chair 1.

While the preferred embodiment of the invention has been set forth for the purpose of disclosure, modifications of the disclosed embodiment of the invention as well as other embodiment thereof may occur to those skilled in the art. Accordingly, the appended claims are intended to cover all embodiments which do not depart from the spirit and scope of the invention.

What is claimed is:

1. A rocking chair structure comprising:

a support frame having two sides;

a chair mounted on the support frame by a first and a second pair of swinging bars, the swinging bars each comprising two ends that are pivotally engaged to a respective one of the two sides of the support frame and the chair via pivotal shafts located at junctures of the support frame and the chair thereby permitting the chair to swing to and fro relative to the frame about the pivotal shafts which function as fulcrums, while the chair is suspended above the support frame; and a restrictive rod comprising two ends, the ends of the restrictive rod are pivotally connected between the first pair of swinging bars, thereby limiting swinging angle of the first pair of swinging bars in order to maintain swinging of the chair within a selected displacement.

2. The rocking chair structure as claimed in claim 1, wherein the restrictive rod is located adjacent to the junctures between the first pair of swinging bars and the chair.

* * * * *